United States Patent [19]

Eberhardt

[11] 4,129,402

[45] Dec. 12, 1978

[54] SELF-PRIMING CENTRIFUGAL TRASH PUMP

[75] Inventor: Harry A. Eberhardt, Paoli, Pa.

[73] Assignee: Hale Fire Pump Company, Conshohocken, Pa.

[21] Appl. No.: 757,060

[22] Filed: Jan. 5, 1977

[51] Int. Cl.[2] ..... F04D 29/44; F01D 1/02; F01D 9/02; F04D 29/08

[52] U.S. Cl. ..... 415/53 R; 415/172 R; 415/196; 415/204; 415/206

[58] Field of Search ..... 415/201, 204, 216, 217, 415/196, 219 R, 219 C, 121 B, 172 R, 132, 200, 206, 53 R, 170 A, 121 R; 416/146

[56] References Cited

U.S. PATENT DOCUMENTS

| | | | |
|---|---|---|---|
| 2,163,464 | 6/1939 | Llewellyn | 415/197 UX |
| 2,347,386 | 4/1944 | Adams | 415/170 A UX |
| 3,171,357 | 3/1965 | Egger | 415/206 |
| 3,229,641 | 1/1966 | Hessler | 415/201 |
| 3,270,678 | 9/1966 | La Monica | 415/206 |
| 3,276,385 | 10/1966 | Marlow | 415/196 X |
| 3,499,388 | 3/1970 | Eberhardt | 415/204 UX |
| 3,543,368 | 12/1970 | Marlow | 415/196 UX |
| 3,741,679 | 6/1973 | Johnston | 415/170 A |
| 3,776,659 | 12/1973 | Coon, Jr. | 415/200 |
| 3,826,589 | 7/1974 | Frank et al. | 415/201 X |
| 3,829,238 | 8/1974 | Speck | 415/200 X |

*Primary Examiner*—C. J. Husar
*Assistant Examiner*—Donald S. Holland
*Attorney, Agent, or Firm*—Stanley B. Kita

[57] ABSTRACT

A centrifugal pump which is easy to clean, simple to assemble and disassemble, and economical to manufacture is disclosed. The pump comprises two cast metal casing members, one of which has an integral volute wall and the other of which has an oval partition providing an inlet plenum opposite the volute wall. A wear plate is interposed between the casing members to channel fluid in the desired direction through the pump. An impeller is mounted for limited axial adjustment on its engine shaft to adjust its clearance with the wear plate. The impeller also has specially-designed slinger teeth which function to minimize wear of the impeller shaft seal.

19 Claims, 7 Drawing Figures

SELF-PRIMING CENTRIFUGAL TRASH PUMP

FIELD OF THE INVENTION

The present invention relates to centrifugal pumps, and more particularly, the present invention relates to self-priming centrifugal pumps of the type which find particular application in handling viscous fluids or water containing entrained solid matter.

BACKGROUND OF THE INVENTION

Centrifugal pumps which are specially designed to handle viscous fluids such as sludge, sewage, etc., are known. An example of such a pump is disclosed in my U.S. Pat. No. 3,499,388.

While my patented pump functions satisfactorily for its intended purpose, in that it is relatively easy to disassemble for cleaning, the pump is not as inexpensive to manufacture as desired. This is because the pump comprises cast parts which must be core-molded to provide the desired internal flow passages. Core-molded metal castings are complicated to produce, and hence they are expensive to manufacture. Accordingly, a centrifugal pump which does not require a core-molded casing is highly desirable.

So-called trash pumps handling entrained sand or other particles, such as sewage sludge, have certain parts which tend to wear due to the abrasive action of the material flowed through the pump. In addition, depending on the material being pumped, clogging of the internal pump passages can be a serious maintenance problem necessitating periodic cleaning with concomitant pump downtime. Thus, there is a demand for a trash pump which can be cleaned readily and/or disassembled to afford parts replacement.

OBJECTS OF THE INVENTION

With the foregoing in mind, it is a primary object of the present invention to provide an improved centrifugal pump which can be manufactured economically.

It is another object of the present invention to provide a novel centrifugal pump which is designed so as to be assembled and disassembled with a minimum of labor.

Another object of the present invention is to provide a unique centrifugal pump which comprises casing members which can be cast in molds without requiring mold cores to provide internal flow passages.

A further object of the present invention is to provide a centrifugal trash pump designed to afford ready access into its interior for cleaning and maintenance purposes.

Yet another object of the present invention is to provide slinger teeth means on the periphery of a pump impeller operable during pumping to prevent foreign matter from contacting a shaft seal behind the impeller and causing the seal to wear prematurely.

SUMMARY OF THE INVENTION

As a more specific object, the present invention provides a new centrifugal pump comprising two cast casing members and a wear plate interposed therebetween. One casing member mounts an engine which rotates an impeller inside a volute-shaped wall providing a pumping chamber, and the other casing member has an oval baffle opposite the volute wall providing an inlet plenum in fluid communication with the pump inlet and an outlet plenum in fluid communication with the pump outlet. An orifice in the wear plate provides fluid communication between the inlet plenum to the impeller and a vent in the wear plate provides fluid communication between the pumping chamber and the pump outlet plenum. Means is provided to mount the impeller for axial adjustment on the engine shaft to enable the clearance between the impeller and the wear plate to be adjusted. The impeller has a series of peripherally spaced slinger teeth which are designed to prevent solid matter from contacting and wearing the impeller-shaft seal. Means are provided in the wear plate and volute wall to supply fluid to the pumping chamber and thereby to provide the pump with a self-priming capability. A clean-out opening provides access to the inlet plenum, and a clean-out opening provides access to the outlet plenum and enables the position of the pump outlet to be reversed.

BRIEF DESCRIPTION OF THE DRAWINGS

These and other objects, features and advantages of the present invention should become apparent from the following description when taken in conjunction with the accompanying drawings in which.

DESCRIPTION OF THE PREFERRED EMBODIMENT

Figure 1:
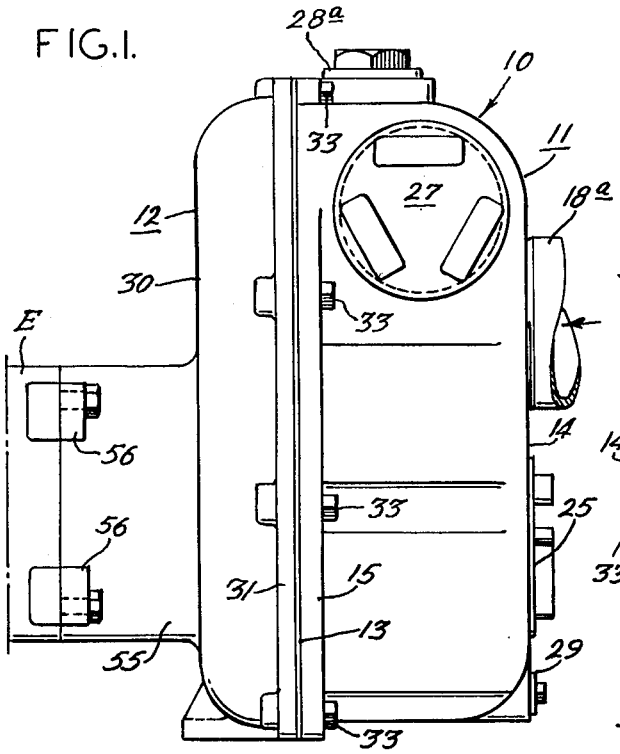
FIG. 1 is a side elevational view of a centrifugal pump embodying the present invention.
Figure 2:
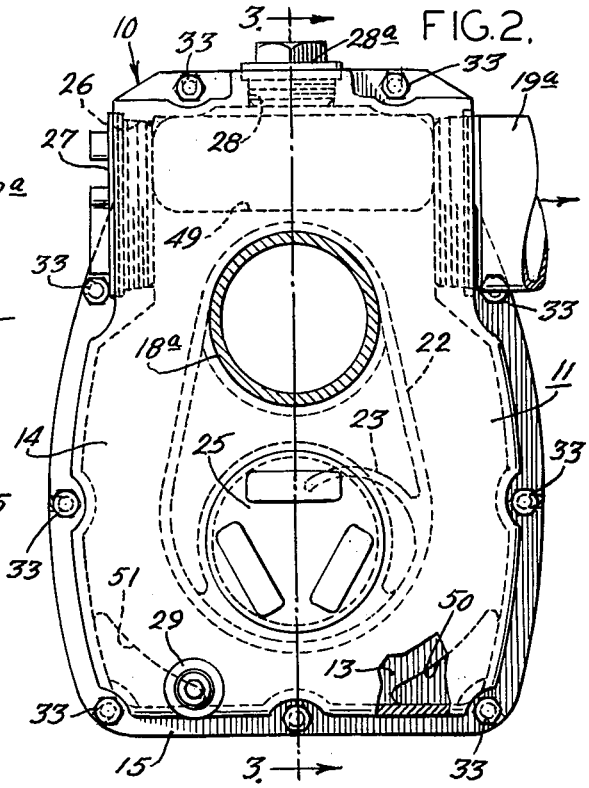
FIG. 2 is an end elevational view looking leftward at the pump in FIG. 1.

Referring now to the drawings, FIGS. 1 and 2 illustrate a self-priming centrifugal pump 10 which embodies the present invention. The pump 10 is designed to handle relatively viscous materials, such as sewage, sludge, etc., which may contain entrained solids, such as sand, paper, etc. The pump 10 may, however, be utilized satisfactorily in many other applications wherein a low-cost, light-weight, self-priming centrifugal pump finds utility.

Figure 3:
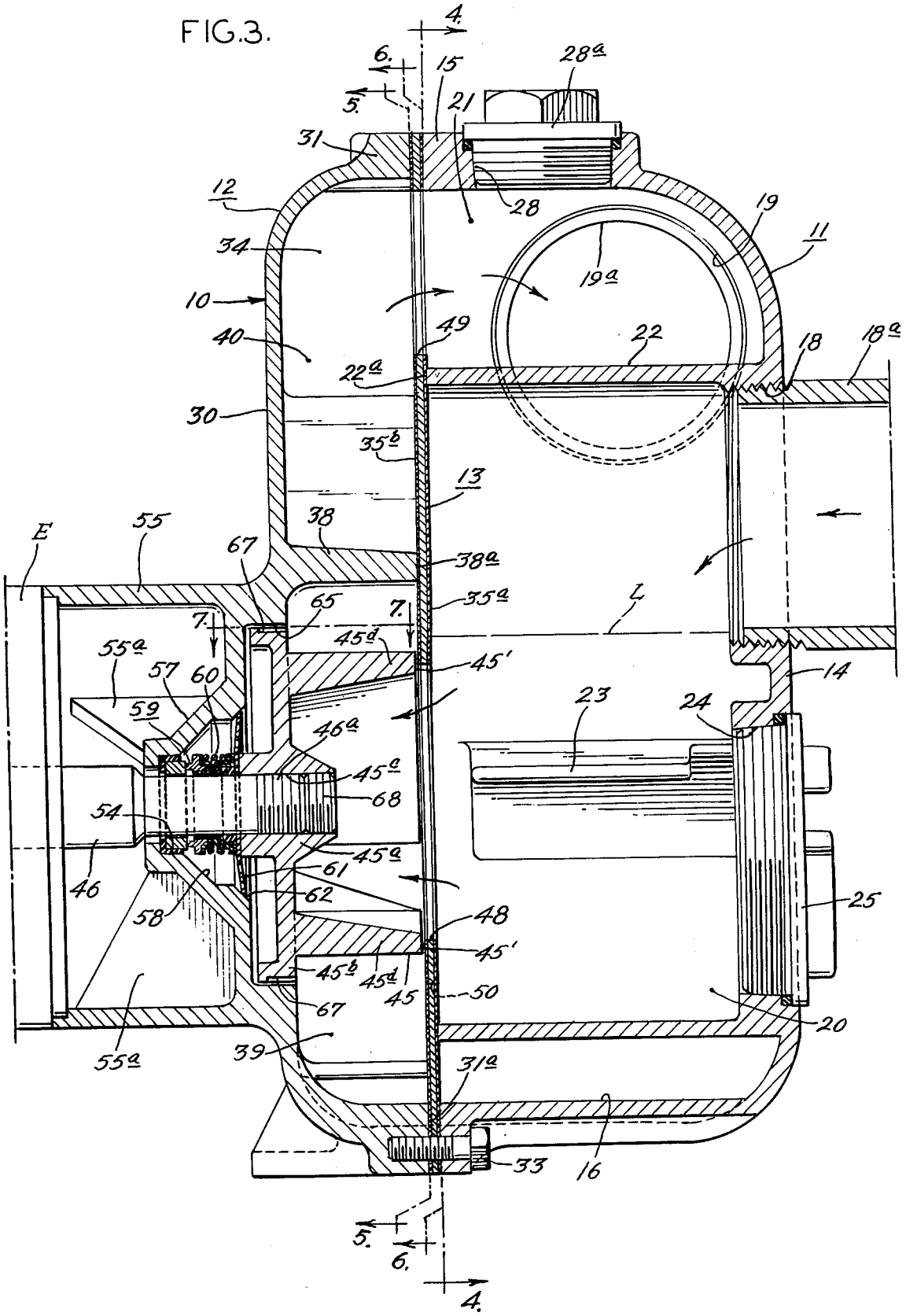
FIG. 3 is an enlarged sectional view taken on lines 3—3 of FIG. 2.

In accordance with the present invention, the pump 10 can be manufactured economically, can be assembled and disassembled readily, and can be periodically cleaned with a minimum of labor and pump downtime. To this end, the pump 10 comprises two casing members 11 and 12, and a divider or wear plate 13 interposed between the casing members for cooperating therewith to provide an interior flow passage in the pump. As best seen in FIG. 3, the first or right-hand casing member 11 has an upstanding endwall 14 with a laterally-extending out-turned peripheral wall or flange 15 which defines a cavity 16 inside the casing member 11. The second casing member 12 has an upstanding endwall 30 with a laterally-directed out-turned peripheral flange 31 which cooperates with the endwall 30 to form a recess 34 in the second casing member. The first and second casing members are releasably fastened together by a series of bolts 33,33 spaced apart in the casing flanges.

In the illustrated embodiment, both the pump inlet and the pump outlet are provided in the first casing member 11. As best seen in FIG. 3, the inlet includes an internally-threaded hole 18 which is located in the endwall 14. The outlet includes an internally-threaded hole 19 which is located in the casing flange 15 slightly above and orthogonal to the inlet 18. The inlet 18 is adapted to receive an inlet pipe 18*a*, and the outlet 19 is adapted to receive an outlet pipe 19*a*.

Figure 4:
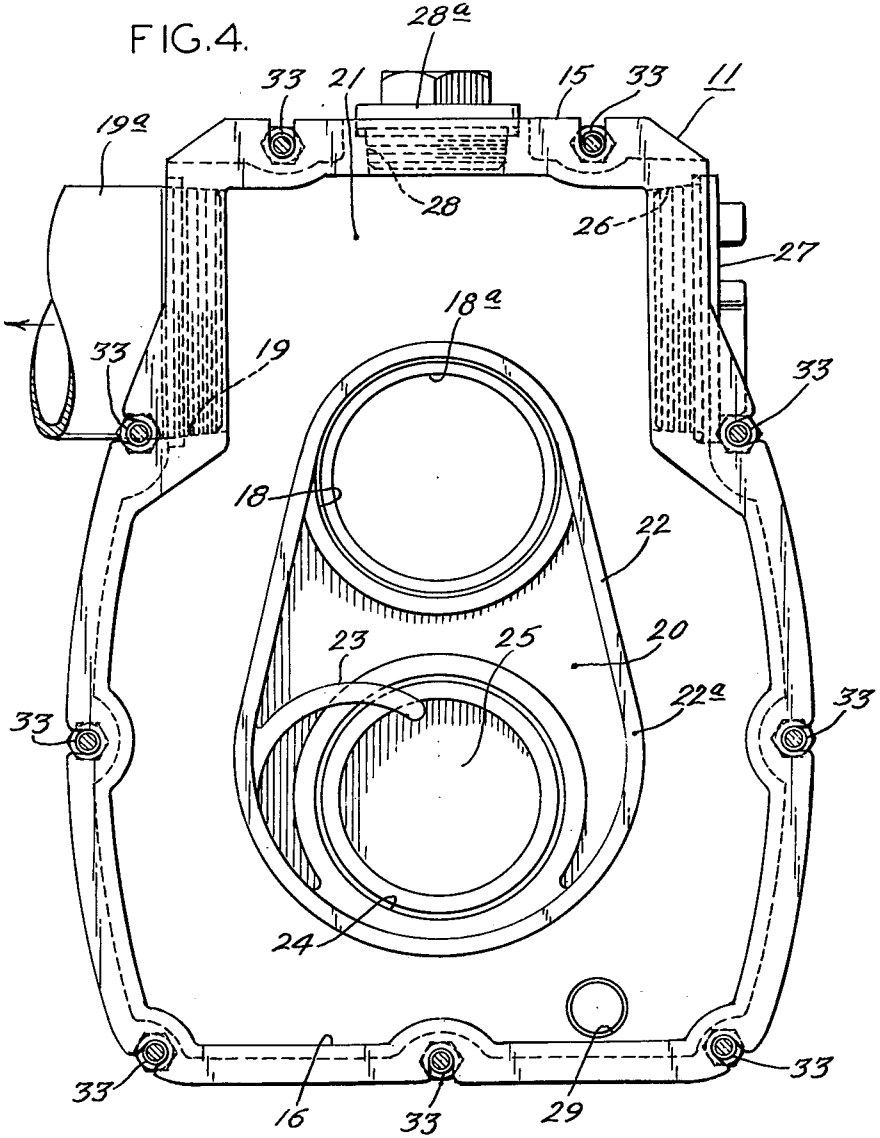
FIG. 4 is a sectional view in reduced scale taken on lines 4—4 of FIG. 3 to illustrate the interior of the first pump-casing member.

As best seen in FIG. 4, the first casing member 11 has an oval baffle or partition 22 which extends inwardly from the casing endwall 14 to divide the cavity 16 into an inlet plenum 20 in fluid communication with the inlet 18 and an outlet plenum 21 in fluid communication with the outlet 19. The second casing member 12 (see FIG. 5) has a volute-shaped wall 38 which extends inwardly from the casing endwall 30 to divide the recess into a pumping chamber 39 interiorly of the volute wall 38 and a discharge chamber 40 exteriorly of the volute wall 38. The divider wear plate 13 is interposed between the terminal edges 22*a* and 38*a* of the baffle 22 and volute wall 38, respectively, when the casing members 11 and 12 are juxtaposed in the manner illustrated in FIG. 3. The divider or wear plate 13 is flat and has a circular orifice 48 providing fluid communication from the inlet plenum 20 to the pumping chamber 39. The divider plate 13 also has a substantially rectangular vent 49 providing fluid communication from the discharge chamber 40 to the outlet plenum 21. Preferably, the divider plate 13 is secured in place by the same bolts 33,33 which fasten the casing members together.

In order to enable the pump 10 to be cleaned readily, an access or clean-out opening 24 is provided in the casing endwall 14 below the inlet 18 and is normally closed by a threaded plug 25. The opening 24 affords access to the interior of the inlet plenum 20. As best seen in FIG. 2, the baffle 22 is vertically elongated, i.e., it has a greater height than width, so that it surrounds both the inlet 18 and the cleanout opening 24 therebelow. A similar clean-out opening 26 (see FIG. 4) closed by a removable plug 27 is provided in the casing flange 15 to afford access into the interior of the discharge plenum 21. The clean-out opening 26 is aligned with the outlet 19 and is of the same size to enable the location of the outlet pipe 19*a* to be reversed, i.e. to extend away from the pump in the opposite direction from the direction illustrated in FIGS. 1 and 2. A drain for the pump 10 is provided by a plugged outlet 29 located near the bottom of the first casing member 11. See FIGS. 1 and 2.

With reference to FIG. 3, impeller means is mounted for rotation interiorly of the volute wall 38 to displace fluid through the pump 10. In the illustrated embodiment, the impeller means includes an impeller 45 mounted on a shaft 46 which is rotated by a conventional power source, such as an electric motor or a small internal combustion engine E. The impeller 45 is of the so-called open-center type and has a working side mounting blades 45*d*,45*d* which are so shaped as to cause fluid to be drawn axially through the divider plate orifice 48 and to force the fluid outwardly under pressure through the divider plate vent 49 when the impeller 45 is rotated rapidly in the direction indicated by the arrow in FIG. 5. The volute wall 38 has a tapered cut-off 69*a* located in close proximity with the periphery of the impeller 45, and the volute wall 38 has an upwardly projecting extension 69*b* providing an upwardly-diverging flow channel away from the cut-off 69*a*. Preferably, a curved vane 23 cast integral with the baffle 22 extends in cantilever fashion into the inlet plenum 20 below the inlet 18 to channel flow in the proper direction toward the orifice 48 and to minimize swirling.

The pump 10 is leak resistant. To this end, the divider plate 13, which is preferably fabricated of steel, is covered on both sides with compressible gaskets 35*a* and 35*b*. The gaskets are preferably fabricated of a material which resists wear due to erosion yet which is sufficiently elastic as to provide a leak-resistant joint between the terminal edges 38*a* and 22*a* of the volute wall 38 and the baffle 22, respectively, and the casing flanges 15 and 31. Preferably, the gasket material is urethane rubber which is bonded to opposite sides of the plate 13. If desired, however, the steel plate may be cadmium-plated and separate gaskets such as paper adhered to the wear plate 13 by shellac at the desired locations.

The divider wear plate 13 is capable of being reversed in position between the first and second casing members 11 and 12. For this purpose, the bolts 33,33 which extend through the peripheral margin of the divider plate 13, are located symmetrical with respect to a vertical axis through the center of the pump. The terminal edges 22*a* and 38*a* abut the gasket material 35*a* and 35*b* on opposite sides of the divider plate 13 and cooperate when the bolts 33,33 are tightened both to provide a leak-resistant joint therebetween and to support the divider plate 13 against vibrations during operation of the pump. Since the bolts 33,33 are symmetrically located, and the holes in the divider plate 13 are similarly located, the divider plate 13 may simply be removed and reversed in the event that one side of the divider plate 13 is worn more than the other.

The engine E is removably mounted to the second casing member 12. For this purpose, a tubular flange 55 having internal gussets 55*a*,55*a* protrudes leftward from the endwall 30 of the second casing member 12, and a series of lugs, such as the lugs 56,56 (FIG. 1) are aligned with a like series of lugs on the engine E. A series of bolts releasably fasten the engine lugs to the casing lugs. The engine shaft 46 extends from the non-working side of the impeller 45 through the endwall 30 centrally of the tubular flange 55.

In order to prevent fluid leakage into the engine E, sealing means is provided. In the present instance, the sealing means includes a frusto-conical wall 57 protruding outwardly from the casing endwall 30 interiorly of the engine mounting flange 55. The wall 57 provides a sealing chamber 58 around the engine shaft 46 and an annular seat or shoulder 54 located closely adjacent the shaft 46. A sealing assembly 59 is mounted in the sealing chamber 58. As best seen in FIG. 3, the sealing assembly 59 includes a helical spring 60 which functions to apply pressure axially between the rear of the hub 45*a* of the impeller 45 and the seat 54. The sealing assembly 59 also includes a flexible disc-like member or slinger 61 which is mounted between the spring 60 and the hub 45*a*. The slinger disc 61 extends across the sealing chamber 58 and has an outer periphery which is flexed forwardly by and slidably engages a chamfered seat 62 which confronts the rear of the impeller 45. The disc 61 functions as described in U.S. Pat. No. 3,499,388 issued to H. A. Eberhardt to prevent solid foreign matter from penetrating the sealing chamber 58 and causing the other elements of the sealing assembly 59 therein to wear.

Figure 7:
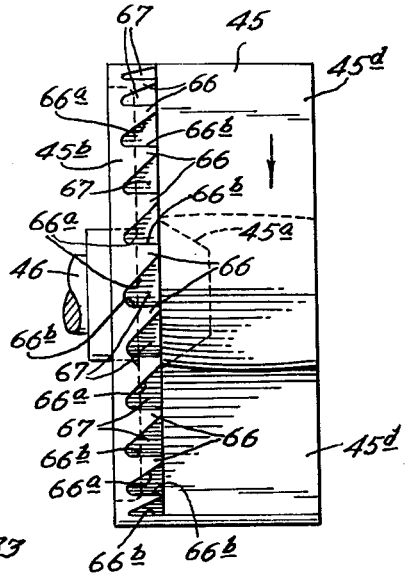
FIG. 7 is a sectional view taken on line 7—7 of FIG. 3 to illustrate the pump impeller means.

According to the present invention, the sealing assembly 59 is protected from wear. For this purpose, the impeller 45 and the casing endwall 30 are specially designed to minimize the tendency for solid particulate foreign matter, such as may be entrained in the water, to get behind the impeller 45, to contact the sealing assembly 59, and possibly causing the sealing assembly 59 to fail prematurely. To this end, shroud means surrounds the periphery of the impeller and cooperates with deflecting surface means on the impeller to deflect solid particulate matter back into the pumping chamber during pumping. In the illustrated embodiment, the shroud means is provided by an inwardly-open, cylindrical wall or recess 65 in the endwall 30 of the second casing member 12, and the impeller 45 has a peripheral flange **45*b* which extends into close proximity with the inner surface of the recess 65. As best seen in FIG. 7, the impeller flange 45*b* has a series of circumferentially-spaced slinger teeth 66,66 separated by shallow recesses 67,67 to provide the deflecting surface means. Each tooth has a leading edge surface 66*a* which is disposed at an acute angle with respect to the rotational axis of the impeller 45, and each tooth has a trailing edge surface 66*b* which extends substantially parallel to the rotational axis of the impeller 45. Each slinger tooth 66 has a predetermined axial dimension, and the cylindrical wall 65 is similarly dimensioned so as to be substantially co-extensive in length with the axial dimension of the impeller tooth 66 such as illustrated in FIG. 3. This insures that the slinger teeth 66 are completely surrounded by the wall or recess 65. Upon rotation of the impeller 45, the slinger teeth or deflecting surface means 66,66 contact the solid foreign matter tending to move outwardly around the periphery of the impeller and deflect the matter inwardly into the pumping chamber. Thus, this structure functions to prevent entrained foreign matter from passing between the periphery of the impeller 45 and its closely adjacent surrounding recess 65 and possibly working its way into the sealing assembly 59 while affording the passage therebetween of water to lubricate the sealing assembly 59**.

Figure 6:
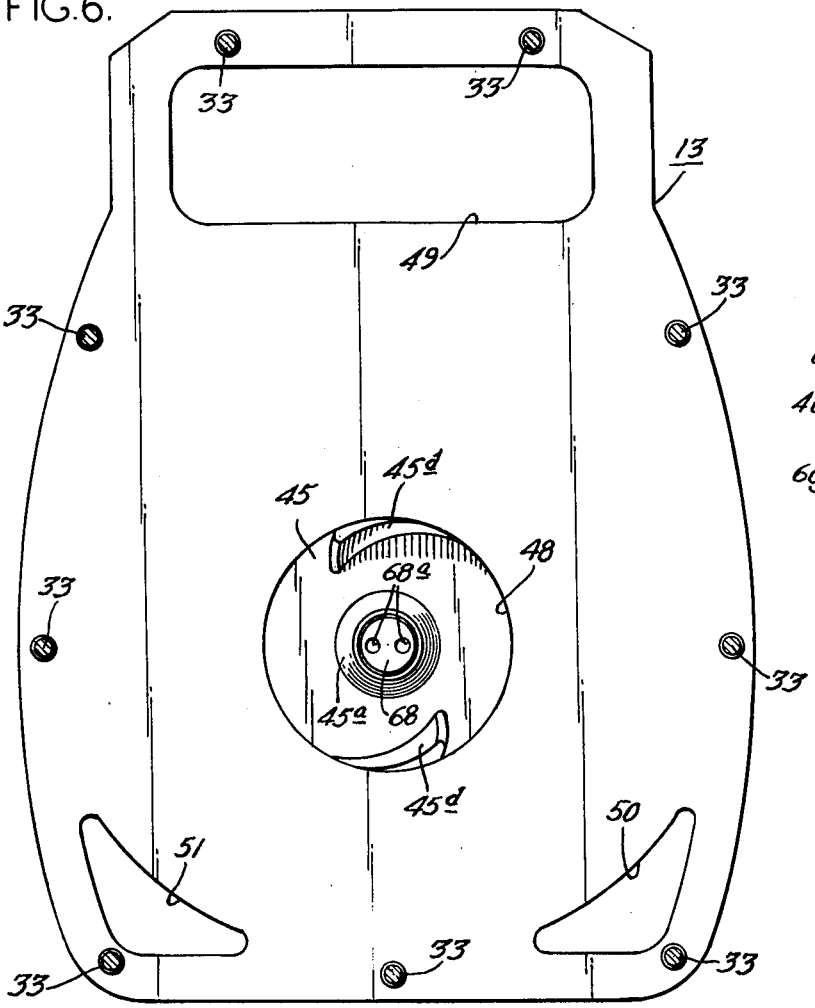
FIG. 6 is a sectional view similar to FIGS. 4 and 5, but taken along lines 6—6 of FIG. 3 to illustrate the configuration of the wear plate mounted between the pump-casing members.

The impeller 45 is mounted for limited axial adjustment on its mounting shaft 46 to facilitate assembly of the pump 10 and to enable compensation to be made for wear of the axial end faces of the impeller blades **45*d*,45*d* and/or the divider plate 13 around the orifice 48 after prolonged usage. For this purpose, the end of the impeller shaft 46 has external threads 46*a* which matingly engage threads on the inside of a bore 45*c* in the impeller 45. A threaded locking member 68 (FIG. 6) having holes 68*a*,68*a* for a spanner wrench is threadably received in the impeller bore 45*c* and engages the end of the impeller shaft 46 to lock the impeller 45 in position on the shaft when the locking member 68 is tightened. By virtue of this structure, the gap between the axial end faces 45',45' of the impeller blades 45*d*,45*d* may be adjusted simply by rotating the impeller 45 relative to the shaft 46 until the desired spacing is achieved and then tightening the locking nut 68**. Preferably, the gap is in a range of 0.020 to 0.030 inches.

Figure 5:
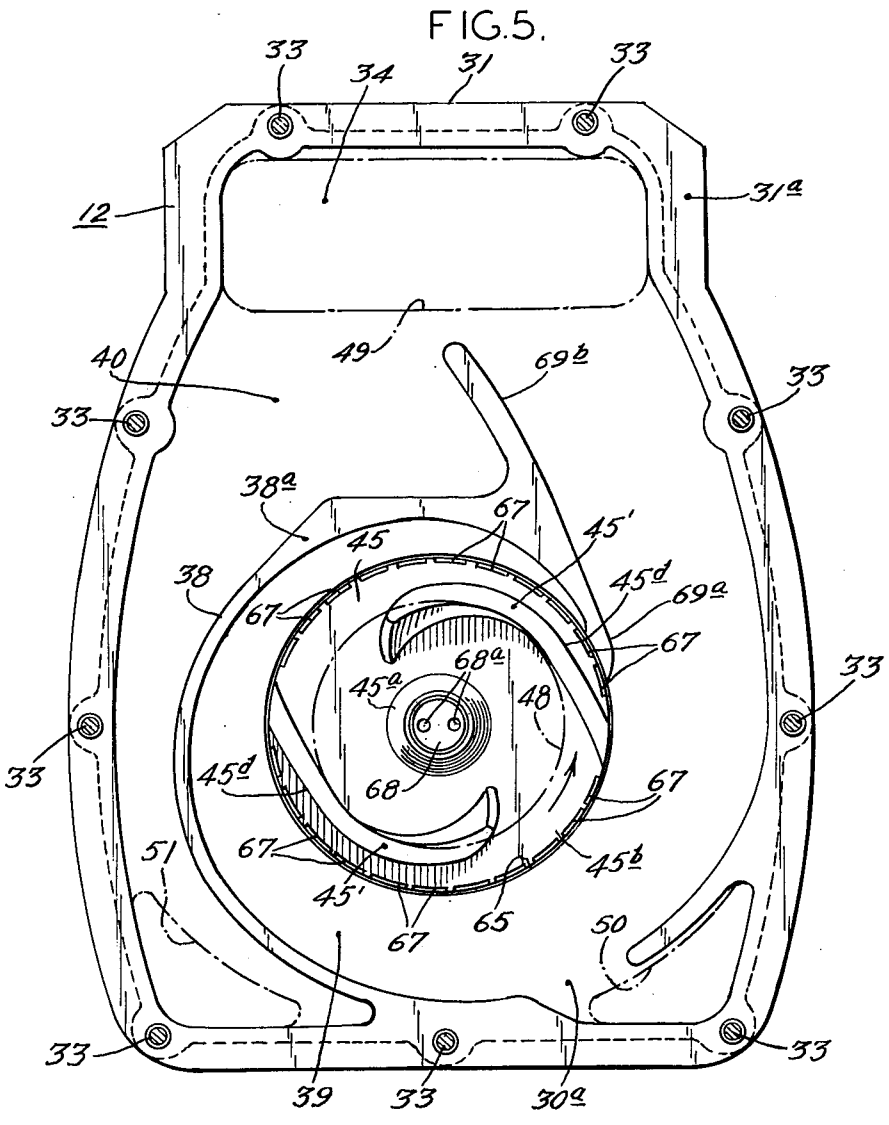
FIG. 5 is a sectional view similar to FIG. 4 but taken on line 5—5 of FIG. 3 to illustrate the interior of the second pump-casing member.

The pump 10 has self-priming capabilities. To this end, the pump 10 is provided with means affording internal fluid recirculation from the outlet plenum 21 to the pumping chamber 39. In the illustrated embodiment, the recirculation providing means includes port means in the divider plate 13 and aperture means in the volute wall 38 providing fluid communication between the outlet or discharge plenum 21 and the pumping chamber 39. As best seen in FIG. 5, the aperture means preferably includes a gap or interruption **30*a* at the five o'clock position in the volute wall 38, and the port means preferably includes a port 50 in the lower right-hand corner of the divider plate 13. The port 50 and the gap 30*a* provide fluid communication to the pumping chamber 39 from the outlet plenum 21 on the opposite side of the divider plate 13. A similar-shaped port 51 is provided in the divider plate 13 at the lower lefthand corner. The port 51 provides fluid communication between the lower portions of the outlet plenum 21 and discharge chamber 40 is casing members 11 and 12, respectively. The port 51 also enables the divider plate 13** to be reversed as discussed above.

The priming cycle will now be described. The initial water level (which may be charged manually or which may be retained) is even with the bottom of the inlet pipe **18*a*, as shown by the dotted line L in FIG. 3. When the impeller 45 begins to rotate, the water in the inlet chamber 20 is drawn down to the bottom of the orifice 48, raising the level in the outlet plenum 21 and discharge chamber 40. The air and water or foaming mixture entrapped in the impeller 45 is peeled off by the close-fitting cut-off 69*a* on the volute wall 38 and is pumped from the interior of the volute 38 to the discharge chamber 40. The air separates from the water in the top of the discharge chamber 40 and outlet plenum 21 and is exhausted through the outlet port 19*a*. Most of the liquid then recirculates by being drawn out of casing 12 through opening 51 in the partition plate 13, into the lower portion of outlet chamber 21 in casing 11, and is subsequently drawn out of this chamber through opening 50 in the plate, then through opening 30*a* into the volute chamber 39, and hence into impeller 45 where it is again mixed with air flowing from the inlet opening 18*a* and into the impeller 45 from inlet chamber 20**.

Thus, rotation of the impeller 45 causes fluid to be recirculated in the pump 10 to enable the pump to prime itself. However, after the pump 10 is stopped, the elevation of the inlet 18 relative to the impeller 45 causes a sufficient quantity of fluid to be retained in the pump 10 to enable the impeller blades to initiate movement of the fluid and to start the reprime cycle. A filling port 28 closed by a threaded plug **28*a* is provided in the top of the first casing member 11 to afford partial filling of the casings with the liquid necessary to initiate the priming action. Also, a plugged drain 29 is provided in the bottom of the first casing member 11** to afford draining of the entire pump assembly when desired.

The pump assembly 10 described heretofore provides a number of advantages. First of all, each casing member can be cast without the use of cores to provide internal flow passages in the pump. This enables significant manufacturing economies to be realized. In addition, machining time for the various precision surfaces on the casing members is reduced, since each casing member is smaller and can be handled readily. Also, the casing members are designed to enable a number of different machining operations to be performed in the same set-up. For instance, the impeller receiving recess 65, the slinger disc seat 62, and the seal assembly seat bore 54 on the second casing member 12 are concentric with one another so that they can be bored at the same time that the terminal edge **38*a* of the volute 38 and the terminal edge 31*a* of the flange 31** are machined. Thus, the time required to machine the cast parts is kept to a minimum.

Of further importance is the fact that one casing member may be cast of a metal different from the other to provide wear resistance where needed while maintaining a relatively lightweight overall assembly. For instance, the first casing member 11 is preferably fabricated of cast aluminum, and the second casing member 12 is preferably fabricated of cast iron. Of course, if desired, other strong yet lightweight materials may be utilized where manufacturing cost is less of a consideration. Lastly, since the two casing members 11 and 12 are simply bolted together, they can be assembled and disassembled readily without any special tools and with a minimum of labor.

While a preferred embodiment of the present invention has been described in detail, various modifications, alterations and changes may be made without departing from the spirit and scope of the present invention as defined in the appended claims.

I claim:

1. A centrifugal pump, comprising:

a first casing member having an endwall with a laterally-extending peripheral flange cooperating therewith to form a cavity, means providing an inlet in said first casing member, means providing an outlet in said first casing member, a baffle extending around said inlet means and into said cavity to divide said cavity into an inlet plenum in fluid communication with said inlet means and an outlet plenum in fluid communication with said outlet means, a second casing member having an endwall with a laterally-extending peripheral flange cooperating therewith to form a recess, a volute-shaped wall extending into said recess to divide said recess into a pumping chamber interiorly thereof and a discharge chamber exteriorly thereof, a divider plate interposed between said first and second casing members and extending transversely across said partition and volute-shaped wall, said divider plate having an orifice below said inlet means providing fluid communication between said inlet plenum and said pumping chamber and having a vent providing fluid communication between said discharge chamber and said outlet plenum.

said divider plate, baffle, and said casing member fastening means being disposed symmetrically with respect to a vertical axis through the pump assembly to enable the divider plate to be reversed in position between the casing members, impeller means rotatably mounted in said pumping chamber, and means releasably fastening said first and second casing members together with said divider plate therebetween, whereby rotation of the impeller causes fluid to flow through the pump.

2. A centrifugal pump according to claim 1 including means providing a first clean-out opening in said first casing member endwall adjacent said inlet means and in substantial registry with said orifice in said divider plate, and means providing a second clean-out opening in said first casing member flange in substantial registry with said outlet means therein.

3. A pump according to claim 1 wherein said baffle is vertically-elongated and said pump inlet is offset axially upward from said orifice in said divider plate, and including means in the endwall of said first casing member providing a normally-plugged opening below said inlet to afford access to the impeller means.

4. A pump according to claim 3 wherein said baffle has a periphery spaced from the peripheral flange of said first casing member so that said outlet plenum surrounds said baffle, said outlet means includes a pair of aligned outlets in said first casing flange above said baffle with said divider plate vent extending between said outlets above said baffle.

5. A centrifugal pump according to claim 1 wherein said volute-shaped wall has means providing an aperture therein, and wherein said divider plate has port means affording fluid communication from said outlet plenum on one side of said divider plate and into said pumping chamber on the other side of said divider plate to provide said pump with self-priming capabilities.

6. In a pump having a casing with an inlet and an outlet, an impeller having a working side and a non-working side mounted in said casing, shaft means extending through said casing and mounting said impeller for rotation therein, and sealing means surrounding said shaft on the non-working side of said impeller, the improvement comprising means for protecting said sealing assembly against premature failure by contact therewith of foreign matter entrained in fluid handled by said impeller, said protecting means including deflecting surface means comprising a series of slinger teeth spaced apart on the periphery of the impeller with respect to the direction of rotation of the impeller during pumping to deflect foreign matter toward the working side of said impeller, and means providing a shroud surrounding in close proximity the periphery of the deflecting surface means for cooperating therewith to prevent passage of foreign matter to the non-working side of the impeller during operation of the pump, each of said teeth having a leading edge surface disposed at an acute angle with respect to the rotational axis of the impeller and a shallow recess behind said leading edge.

7. Apparatus according to claim 6 wherein each tooth has a predetermined axial dimension and said shroud is coextensive with said dimension.

8. Apparatus according to claim 7 wherein each tooth has a trailing edge disposed substantially parallel to the rotational axis of the impeller.

9. A centrifugal pump comprising:

a first casing member having an endwall with a laterally-extending peripheral flange cooperating therewith to form a cavity, means providing an inlet in said first casing member, means providing an outlet in said first casing member, a baffle extending around said inlet means and into said cavity to divide said cavity into an inlet plenum in fluid communication with said inlet means and an outlet plenum in fluid communication with said outlet means, a curved vane protruding from said baffle and into said inlet plenum below said inlet means for guiding fluid in the inlet plenum, a second casing member having an endwall with a laterally-extending peripheral flange cooperating therewith to form a recess, a volute-shaped wall extending into said recess to divide said recess into a pumping chamber interiorly thereof and a discharge chamber exteriorly thereof, a divider plate interposed between said first and second casing members and extending transversely across said partition and volute-shaped wall, said divider plate having an orifice providing fluid communication between said inlet plenum and said pumping chamber and having a vent providing fluid communication between said discharge chamber and said outlet plenum, impeller means rotatably mounted in said pumping chamber, and means releasably fastening said first and second casing members together with said divider plate therebetween, whereby rotation of the impeller causes fluid to flow through the pump.

10. A centrifugal pump, comprising:

a first casing member having an endwall with a laterally-extending peripheral flange cooperating therewith to form a cavity, means providing an inlet in said first casing member, means providing an outlet in said first casing member, a baffle extending around said inlet means and into said cavity to divide said cavity into an inlet plenum in fluid communication with said inlet means and an outlet plenum in fluid communication with said outlet means, a second casing member having an endwall with a laterally-extending peripheral flange cooperating therewith to form a recess, a volute-shaped wall extending into said recess to divide said recess into a pumping chamber interiorly thereof and a discharge chamber exteriorly thereof, a divider plate interposed between said first and second casing members and extending transversely across said partition and volute-shaped wall, said divider plate having an orifice providing fluid communication between said inlet plenum and said pumping chamber and having a vent providing fluid communication between said discharge chamber and said outlet plenum, impeller means rotatably mounted in said pumping chamber, including an impeller having a peripheral flange and a series of peripherally spaced slinger teeth on said impeller flange, means in said second casing member providing a cylindrical wall located in close proximity with said slinger teeth, said slinger teeth having triangular shapes each with a leading surface disposed at an acute angle relative to the rotational axis of the impeller and a shallow recess behind the leading surface and operable upon rotation of the impeller to sweep along said cylindrical wall to prevent entrained solid particles from passing around the periphery of the impeller, and means releasably fastening said first and second casing members together with said divider plate therebetween, whereby rotation of the impeller causes fluid to flow through the pump.

11. A centrifugal pump, comprising:

a first casing member having an endwall with a laterally-extending peripheral flange cooperating therewith to form a cavity;

means in the endwall of said first casing member providing an inlet therethrough;

means in the flange of said first casing member providing at least one outlet adjacent said inlet;

means providing a vertically-elongated baffle surrounding and depending below said inlet means and extending into said cavity to divide said cavity into an inlet plenum in fluid communication with said inlet means and an outlet plenum in fluid communication with said outlet means;

means providing a normally-plugged access opening in the endwall of said first casing member below said inlet means and opening into the inlet plenum;

a second casing member having an endwall with a laterally-extending peripheral flange cooperating therewith to form a recess;

a volute-shaped wall extending into said recess to divide said recess into a pumping chamber interiorly thereof and a discharge chamber exteriorly thereof;

means providing a gap in said volute-shaped wall adjacent the bottom thereof to provide fluid communication between said pumping chamber and said discharge chamber;

a divider plate interposed between said first and second casing members and extending transversely across said baffle and volute-shaped wall;

said divider plate having an orifice below said inlet providing fluid communication between said inlet plenum and said pumping chamber, a vent above said orifice providing fluid communication between said discharge chamber and said outlet plenum, and port means below said orifice providing fluid communication between said outlet plenum and said gap in said volute wall;

said divider plate orifice, vent, and port means and said releasable fastening means being symmetrical with respect to a vertical axis through the pump to afford reversability of said divider plate;

impeller means rotatably mounted in said pumping chamber, and means releasably fastening said first and second casing members together with said divider plate therebetween.

12. A centrifugal pump according to claim 11 including means defining an inwardly-open sealing chamber in said second casing member outwardly of said impeller means, a sealing assembly mounted in said sealing chamber and having a slinger disc mounted across said sealing chamber for rotation with said impeller means.

13. A centrifugal pump according to claim 11 wherein the peripheral flanges of both casing members, and the baffle and volute-shaped walls thereof, have terminal edges abutting opposite sides of said divider plate to secure the divider plate therebetween.

14. A centrifugal pump according to claim 13 wherein said divider plate is planar and carries gasket means on opposite sides thereof to provide a fluid-tight joint with said terminal edges.

15. A centrifugal pump according to claim 14 wherein said casing member fastening means includes outturned flanges extending from the peripheral flanges of said first and second casing members and a series of bolts spaced apart in said outturned flanges of the casing members and extending through said divider plate to releasably fasten said casing members together and to clamp said divider plate therebetween.

16. A centrifugal pump according to claim 11 wherein said baffle is cast integral with said first casing member and said volute shaped wall is cast integral with said second casing member, and said first casing member is cast of one material and said second casing member is cast of a different material.

17. A centrifugal pump according to claim 16 wherein said material is aluminum and said other material is iron.

18. A centrifugal pump according to claim 11 wherein said impeller means includes a shaft protruding through said second casing member endwall, an impeller mounted on said shaft, sealing means surrounding said shaft between said endwall and said impeller, and adjusting means mounting said impeller for axial adjustment on said shaft to afford adjustment of the spacing between the impeller and the divider plate.

19. A centrifugal pump according to claim 18 wherein said sealing means includes elastic means biasing said impeller toward said divider plate, and said impeller adjustment means includes an internally-threaded bore in said impeller and external threads on said shaft matingly engaged therewith to afford axial movement of the impeller on the shaft upon rotation of one relative to the other, and locking means threadedly engaging in said impeller bore and against the end of the shaft for releasably securing said impeller in selected axially-adjusted positions on said shaft.

* * * * *